United States Patent [19]

Miyauchi et al.

[11] Patent Number: 4,975,746

[45] Date of Patent: Dec. 4, 1990

[54] PROCESS CARTRIDGE AND IMAGE FORMING APPARATUS USING SAME

[75] Inventors: Yasuo Miyauchi, Yokohama; Akio Takeda, Kawasaki; Haruo Uchida, Yokohama; Yasutsugu Saijo, Tokyo; Akihiro Nomura, Yokohama, all of Japan

[73] Assignee: Canon Kabushiki Kaisha, Tokyo, Japan

[21] Appl. No.: 387,813

[22] Filed: Aug. 1, 1989

[30] Foreign Application Priority Data

Aug. 4, 1988 [JP] Japan ..... 63-193470

[51] Int. Cl.[5] ..... G03G 15/06

[52] U.S. Cl. ..... 355/245; 355/259

[58] Field of Search ..... 355/245, 246, 259, 260, 355/270; 118/661

[56] References Cited

U.S. PATENT DOCUMENTS

| | | | |
|---|---|---|---|
| 3,256,855 | 4/1963 | Oliphant | 118/661 X |
| 3,808,025 | 4/1974 | Fukushima et al. | 355/246 X |
| 4,400,079 | 8/1983 | Landa | 355/259 X |
| 4,714,337 | 12/1987 | Nishino et al. | 355/200 |
| 4,768,055 | 8/1988 | Takamatsu et al. | 355/298 |

*Primary Examiner*—Fred L. Braun
*Assistant Examiner*—Nestor R. Ramirez
*Attorney, Agent, or Firm*—Fitzpatrick, Cella, Harper & Scinto

[57] ABSTRACT

The present invention relates to a process cartridge removably mountable on an image forming apparatus comprising a support, a rotary member having an image bearing surface and rotatably supported by the support, and a rotatable developing roller supported by the support, for carrying developer thereon and supplying the developer to the image bearing surface to develop a latent image formed on the image bearing surface. A first gear is arranged coaxial with the rotary member, a second gear is arranged coaxial with the developing roller and meshed with the first gear, and a guide means is provided for guiding the developing roller in a direction toward and away from the rotary member. The direction in which the developing roller is guided by the guide means is inclined with respect to a straight line connecting the center of rotation of the rotary member to the center of rotation of the developing roller, by an angle between $0.7\times\Theta$ ($\Theta$ is a pressure angle of the second gear) and $1.3\times\Theta$. The cartridge further includes a bias means for biasing the developing roller toward the image bearing surface.

7 Claims, 3 Drawing Sheets

PROCESS CARTRIDGE AND IMAGE FORMING APPARATUS USING SAME

BACKGROUND OF THE INVENTION

1. Field of the Invention

The present invention relates to a process cartridge which can be mounted on an image forming apparatus such as an electrophotographic copying machine, electrophotographic laser beam printer and the like, and an image forming apparatus using such process cartridge.

2. Related Background Art

A process cartridge including a rotary member having an image bearing surface on which a latent image is formed, and a rotatable developing roller for carrying developer thereon and for supplying the developer to the image bearing surface has already been known. In such conventional process cartridge, in order to correctly maintain the relative positional relation between the image bearing surface and the developing roller, a developing unit having the abovementioned developing roller and a container containing the developer to be supplied to the developing roller was movably arranged in a casing of the cartridge and the whole unit was biased toward the image bearing surface. However, with this conventional arrangement, there arose drawbacks that the cartridge was wholly large-sized, the construction thereof was complicated and/or an area or space for containing the developer was relatively small.

SUMMARY OF THE INVENTION

It is an object of the present invention to provide a process cartridge, and an image forming apparatus using such process cartridge, which can eliminate the above-mentioned conventional drawbacks.

Another object of the present invention is to provide a process cartridge, and an image forming apparatus using such process cartridge, which has a simple construction and which can maintain the relative positional relation between a developing roller and an image bearing surface with high accuracy.

Still other objects and features of the present invention will be apparent from the explanation described hereinbelow.

DESCRIPTION OF THE PREFERRED EMBODIMENTS

Figure 1:
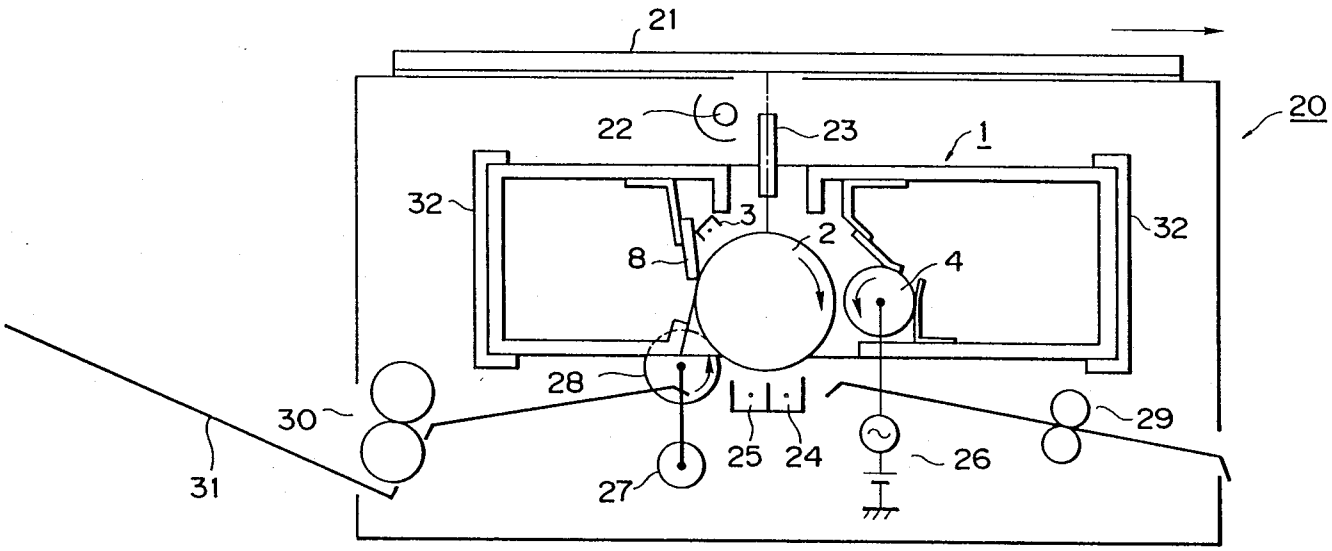
FIG. 1 is a schematic sectional elevational view of an image forming apparatus according to a preferred embodiment of the present invention.

In FIG. 1, an electrophotographic apparatus 20 as an image forming apparatus includes guide members 32 for removably supporting a process cartridge 1 which will be described later. When an operator pulls the process cartridge 1 toward this side in FIG. 1 along the guide members 32, the cartridge 1 can be removed from the electrophotographic apparatus 20; whereas, by pushing the cartridge 1 toward the other side in FIG. 1 along the guide members 32, the cartridge can be mounted on the electrophotographic apparatus 20.

The electrophotographic apparatus 20 comprises an original support 21 on which an original to be copied is supported, a lamp 22 for illuminating the original, an optical system 23 for projecting an image on the original onto an electrophotographic photosensitive member and for exposing the image on such member, a transfer charger 24 for transferring a developer image formed on the photosensitive member onto a transfer sheet, a separation discharger 25 for separating the transfer sheet from the photosensitive sheet, feed rollers 29 for feeding the transfer sheet in a transfer station, a fixing device 30 for fixing the transferred image on the transfer sheet, a tray 31 for receiving the transfer sheet after the image is fixed thereon, a power source 26 for applying developing bias voltage to a developing roller 4, a drive motor 27, and a transmission gear 28 for transmitting the driving force of the drive motor 27 to the cartridge 1.

In a condition that the process cartridge 1 is mounted on the electrophotographic device 20, when a copy start switch (not shown) is turned ON, the drive motor 27 is driven to rotate a cylindrical drum 2 around which the photosensitive member is carried in a direction shown by the arrow. The photosensitive member is firstly charged uniformly by the charger 3 and then, the image on the original supported on the original support 21 (which is shifted in a direction shown by the arrow) is illuminated by the lamp 22, with the result that the image is projected on the photosensitive member through the optical system 23, thus forming an electrostatic latent image on the photosensitive member. In a developing station, the latent image is developed by the developer carried by the cylindrical developing roller 4 rotated in a direction shown by the arrow. A minimum gap a between the developing roller 4 and the photosensitive member on the drum 2 is selected to have a value of 50 μm–400 μm, and, in the developing station, a thin layer of the developer having a thickness smaller than the above-mentioned minimum gap is formed on the developing roller 4. Accordingly, in the developing station, the developing of non-contact type is performed.

Further, when the process cartridge 1 is mounted on the electrophotographic apparatus 20, contacts (not shown) are closed, whereby it is possible to apply the bias voltage from the power source 26 to the developing roller 4. During the developing operation, the bias voltage obtained by adding DC voltage to AC voltage (sine wave, rectangular wave, delta wave and the like) is applied to the developing roller 4, whereby, in the developing station, an alternating electric field a direction of which is changed alternately is formed between the photosensitive member and the developing roller. By the alternating electric field, the developer is vibrated lively, thus visualizing the electrostatic latent image. In such developing device, in order to obtain a good image, it is particularly important to correctly maintain the gap a between the photosensitive member and the developing roller. Incidentally, as the developing bias voltage, DC bias voltage not including AC component may be used; also in this case, it is important to correctly maintain the gap a between the photosensitive member and the developing roller.

By means of the transfer charger 24, the developed image is transferred onto the transfer sheet fed by the rollers 29. The transfer sheet is separated from the photosensitive member by means of the discharger 25, and is moved toward the fixing device 30. The residual developer remaining on the photosensitive member after the transferring operation is removed by a cleaning blade 8.

Figure 2:
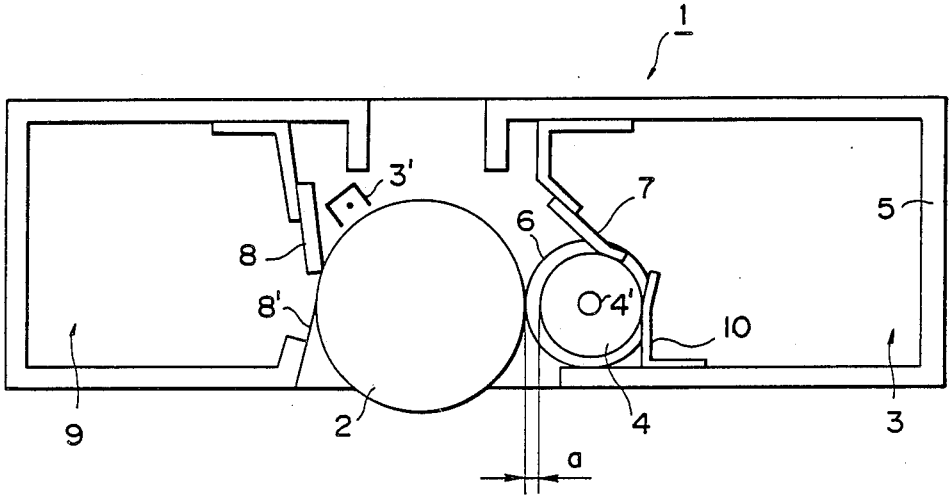
FIG. 2 is a schematic sectional elevational view of a process cartridge according to a preferred embodiment of the present invention.

As shown in FIG. 2, the process cartridge 1 has an integrally molded casing 5. Into the casing 5, the photosensitive drum 2, a charger 3', a developing portion and a cleaning portion are incorporated. More particularly, the photosensitive drum 2 is rotatably mounted on the casing 5, and the developing roller 4 constituting the developing portion is rotatably supported by the casing 5 in parallel with the photosensitive drum 2. Further, a blade 7 for regulating the thickness of the developer layer is fixedly or rotatably mounted on the casing 5 to be pressed against the developing roller 4. The blade 7 may comprise an elastic plate such as a rubber plate made of urethane rubber, silicone rubber and the like, or a metallic spring plate made of stainless steel, phosphoric bronze and the like, and is pressed against the developing roller 4 with its undersurface. The blade 7 is received in a chamber 3 formed in the casing 5 to form the thin developer layer on the developing roller 4.

On both ends of the developing roller 4, spacer rollers 6 are provided in coaxial with the roller 4. These spacer rollers 6 contact with the photosensitive drum 2, thus creating and maintaining the gap a between the developing roller 4 and the photosensitive member on the drum 2. In order to press the spacer rollers 6 against the drum 2, springs 10 are attached to the casing 5, which springs 10 elastically bias the developing roller 4 toward the drum 2. The springs 10 are pressed against the developing roller 4 in areas situated on both sides of the developing roller 4 and outside an area where the developer layer is formed by the blade 7. The springs may be engaged by end shafts 4' of the roller 4 to bias the roller 4 toward the drum 2.

Further, the cleaning blade 8 and a collector sheet 8' which constitute the cleaning portion are fixedly or rotatably mounted on the casing 5 to be pressed against the drum 2. The developer removed by the cleaning blade 8 and collected by the collector sheet 8' is stored in a chamber 9 formed in the casing 5.

While the process cartridge including the cleaning means and the charger 3, as well as the drum 2 and the developing means was explained, the present invention can be applied to a process cartridge not including the cleaning means and/or the charger.

Figure 3:
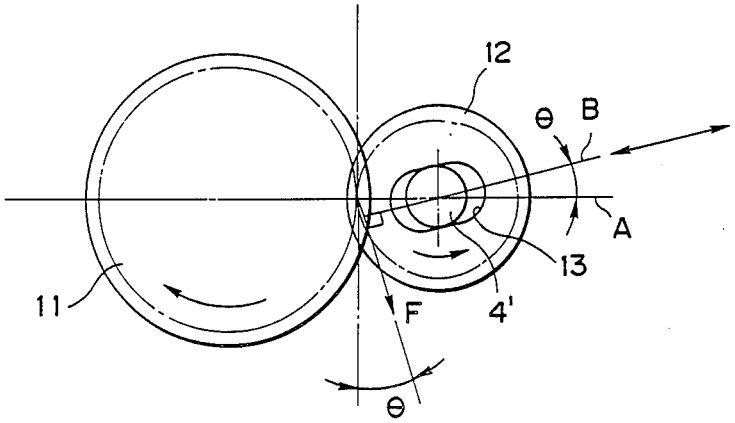
FIG. 3 shows a gear train used in the process cartridge of FIG. 2.

As shown in FIG. 3, a first gear 11 is fixed to one end of the drum 2 in coaxial with the latter, and a second gear 12 is fixed to one end of the developing roller 4 in coaxial with the latter. The first and second gears 11 and 12 are meshed with each other so that the drum 2 is rotated in synchronous with the developing roller 4. When the process cartridge 1 is mounted on the apparatus 20, the first gear 11 is engaged by the transmission gear 28 driven by the drive motor 27. In this way, by energizing the drive motor 27, the drum 2 is rotated, and the developing roller 4 is also rotated through the engagement between the gears 11, 12 in a direction opposite to that of the drum 2. The end shafts 4' (only one of which is shown in FIG. 3) of the developing roller 4 are rotatably received in corresponding elongated slots 13 formed in the casing 5 and can be shifted along the slots. Accordingly, the developing roller 4 can be linearly shifted toward and away from the drum 2 along the slots 13. Incidentally, as shown in FIG. 3, a longitudinal axis B of each slot 13 for supporting the developing roller 4 is inclined with respect to a line A connecting a center of rotation of the photosensitive drum 2 and a center of rotation of the developing roller 4, by an angle $\theta$ corresponding to a pressure angle $\theta$ of the gears 11, 12 in a direction of rotation of the developing roller 4. That is to say, the developing roller 4 can be linearly shifted along the straight or linear line B inclined with respect to the straight line A by the angle $\theta$. With such arrangement, even if a force F in a direction of the pressure angle $\theta$ is applied to the gear 12 when the rotational driving force is transmitted from the gear 11 to the gear 12, the developing roller 4 is prevented from shifting away from the photosensitive drum 2.

That is to say, since the direction of the straight line B is perpendicular to the direction of the force F, when the force F acts on the second gear 12, the force F urges the end shafts 4' against lower sides of the slots 13, thus preventing the generation of a component of a force tending to displace the shafts 4' along the line B.

Incidentally, in FIG. 3, the longitudinal axis of each slot 13 and accordingly the direction along which the roller 4 is guided may be set in a direction inclined with respect to the line A by any angle between $0.7\times\theta$ and $1.3\times\theta$ in an anticlockwise direction from the line A. In other words, even if the longitudinal axis of each slot 13 is set in a direction inclined by any angle within $0.3\times\theta$ in a clockwise direction or within $0.3\times\theta$ in an anticlockwise direction from the direction perpendicular to that of the force F, it was found that the developing roller 4 could be prevented from shifting along the longitudinal axes of the slots 13 during the rotation of the roller 4.

In this way, even when the load torque of the developing roller 4 is varied with time or under circumstance, since the pressing force of the spacer rollers 6 against the drum is maintained constant by means of the springs 10, the gap between the photosensitive drum 2 and the developing roller 4 can be stably maintained, thus establishing the good developing condition.

Figure 4:
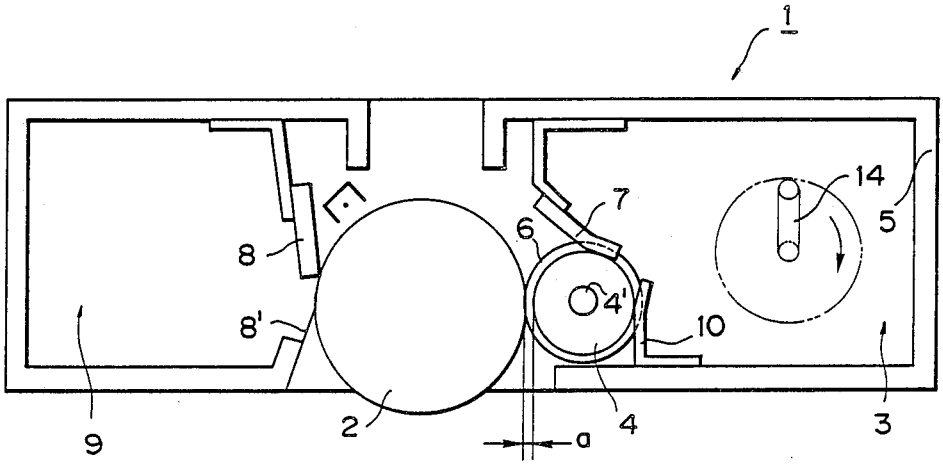
FIG. 4 is a schematic sectional elevational view of a process cartridge according to another embodiment of the present invention.

An embodiment shown in FIG. 4, as apparent from this Figure, has a characteristic that an agitating bar 14 for agitating the developer is arranged in the developer containing chamber 3 of the casing 5. The agitating bar 14 serves to prevent the worsening of the fluidity of the developer in the chamber 3 and non-smooth-supply of the developer to the developing roller 4 due to the blocking. The rotational driving force for driving the agitating bar 14 is transmitted from the gear 12 fixed to the developing roller 4 through the gear train. However, since the load of the agitating mechanism varies in accordance with the amount of the developer remained in the developer containing chamber 3, when the shiftable developing roller 4 is used, the size of the gap a between the drum 2 and the developing roller 4 will be unstable.

Figure 5:
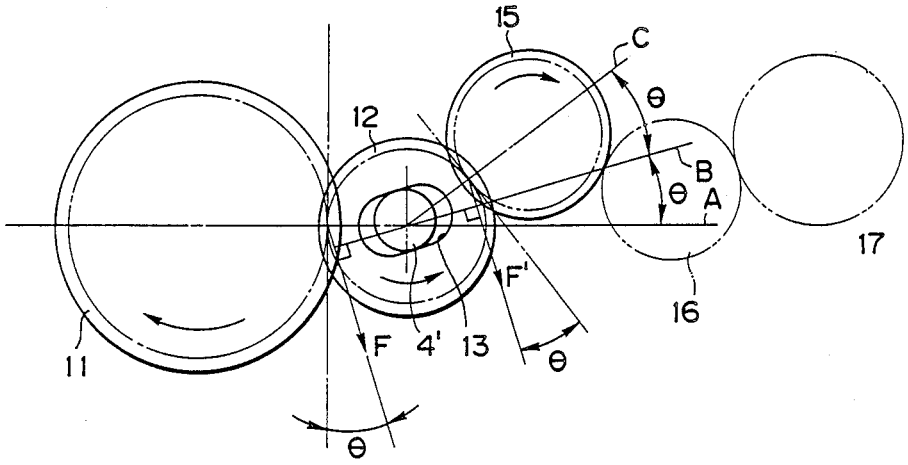
FIG. 5/shows a gear train used in the process cartridge of FIG. 4.

In this embodiment of the present invention, as shown in FIG. 5, the rotational force is transmitted from the gear to the agitating bar 14 through the gear train comprising a gear 15 meshed with the gear 12, an intermediate gear meshed with the gear 16 and a gear 17 meshed with the intermediate gear 16 and fixed to the agitating bar 14 in coaxial with the latter. In this gear train, a center of rotation of the gear is situated on a straight line C inclined with respect to the direction B to which the developing roller is shifted, by an angle $\theta$ equal to the pressure angle $\theta$ of the gear 12 and accordingly the gear 15. That is to say, in the engagement area between the gear 12 and 15, a direction of a force F', which is transmitted from the gear 15 to the gear 12 is perpendicular to the straight line B, i.e., the direction to which the developing roller 4 is shifted.

In this way, the force F' which is transmitted from the gear 15 to the gear 12 is restrained by the elongated slots 13, as in the case of the above-mentioned force F, thereby preventing the generation of a resultant force tending to displace the developing roller 4 in the direction B.

Incidentally, in FIG. 5, the straight line C may be inclined with respect to the direction to which the developing roller 4 is shifted, by any angle between $0.7\times\theta$ and $1.3\times\theta$ in an anticlockwise direction from the line B. That is to say, even if the center of rotation of the gear 15 is situated on a line inclined by any angle within $0.3\times\theta$ in a clockwise direction or within $0.3\times\theta$ in an anticlockwise direction from the direction perpendicular to the force F', it was found that the same effect could be obtained.

On the other hand, the angular relation between the direction of the force F and the longitudinal direction of each slot 13 is selected in the same manner as in the case of FIG. 2. Accordingly, even when the agitating means is required, the gap a between the photosensitive drum 2 and the developing roller 4 can be maintained to have a proper value.

Incidentally, while an example that the end shafts 4' are received in the corresponding elongated slots 13 was explained, bearing members such as ball bearings rotatably mounted on the end shafts 4' may be received in the corresponding slots 13. Further, the end shafts 4' of the developing roller 4 may be rotatably mounted on a carriage shiftable on guide rails oriented to the above-mentioned direction B.

Incidentally, a distance that the developing roller 4 is shifted along the slots and the like is enough to have a value of a few hundreds $\mu$m to 1 mm.

Further, when single component magnetic developer or two component developer including magnetic carrier is used as the developer, the developing roller 4 has a inner cavity in which magnet is arranged. On the other hand, when single component non-magnetic developer is used as the developer, the developing roller 4 may be either solid or hollow.

In addition, the developing roller 4 may be pressed against the drum 2 directly.

Incidentally, as the gears, gears each having a pressure angle of 20 degrees are preferably used. However, gears each having a pressure angle of 14.5 degrees or other pressure angle may be used.

Further, the present invention can be applied to a laser beam printer wherein the photosensitive member is exposed by a laser beam modulated by an image signal, an LED printer wherein the photosensitive member is exposed by an array of light emitting diodes selectively energized in response to the image signal, and the like.

What is claimed is:

1. A process cartridge removably mountable on an image forming apparatus, comprising:

a support;

a rotary member having an image bearing surface and rotatably supported by said support;

a rotatable developing roller supported by said support, for carrying developer thereon and supplying said developer to said image bearing surface to develop a latent image formed on said image bearing surface;

a first gear arranged coaxial with said rotary member;

a second gear arranged coaxial with said developing roller and meshed with said first gear;

a guide means for guiding said developing roller in a direction toward and away from said rotary member, the direction in which said developing roller is guided by said guide means being inclined with respect to a straight line connecting the center of rotation of said rotary member to the center of rotation of said developing roller, by an angle between $0.7\times\theta$ ($\theta$ is a pressure angle of said second gear and $1.3\times\theta$; and a bias means for biasing said developing roller toward said image bearing surface.

2. A process cartridge according to claim 1, further including spacer members provided coaxial with said developing roller, said spacer members being pressed against said rotary member by a biasing force of said bias means.

3. A process cartridge according to claim 1, further including:

a developer containing portion for containing said developer to be supplied to said developing roller;

an agitating member arranged in said developer containing portion, for agitating said developer; and a third gear meshed with said second gear, for transmitting a driving force to said agitating member, the center of rotation of said third gear being situated in a direction inclined with respect to said direction to which said developing roller is guided, by an angle between $0.7\times\theta$ and $1.3\times\theta$.

4. A process cartridge according to claim 2, further including:

a developer containing portion for containing said developer to be supplied to said developing roller;

an agitating member arranged in said developer containing portion, for agitating said developer; and a third gear meshed with said second gear, for transmitting a driving force to said agitating member, the center of rotation of said third gear being situated in a direction inclined with respect to said direction in which said developing roller is guided, by an angle between $0.7\times\theta$ and $1.3\times\theta$.

5. A process cartridge according to claim 1, wherein said first gear meshes with a driving force transmission gear provided in said image forming apparatus, when the process cartridge is mounted on said image forming apparatus.

6. A process cartridge according to claim 2, wherein said first gear meshes with a driving force transmission gear provided in said image forming apparatus, when the process cartridge is mounted on said image forming apparatus.

7. An image forming apparatus comprising:

a support means for removably supporting a process cartridge;

a motor; and a driving force transmission gear for transmitting a driving force generated by said motor;

said process cartridge including a support; a rotary member having an image bearing surface and rotatably supported by said support; a rotatable developing roller supported by said support, for carrying developer thereon and supplying said developer to said image bearing surface to develop a latent image formed on said image bearing surface; a first gear arranged coaxial with said rotary member, said first gear being meshed with said driving force transmission gear when said process cartridge is supported by said support means; a second gear arranged coaxial with said developing roller and meshed with said first gear; a guide means for guiding said developing roller in a direction toward and away from said rotary member, the direction in which said developing roller is guided by said guide means being inclined with respect to a straight line connecting a center of rotation of said rotary member to a center of rotation of said developing roller, by an angle between $0.7\times\theta$ ($\theta$ is a pressure angle of said second gear) and $1.3\times\theta$; a bias means for biasing said developing roller toward said image bearing surface; and spacer members provided in coaxial with said developing roller and pressed against said rotary member by a biasing force of said bias means.

* * * * *

UNITED STATES PATENT AND TRADEMARK OFFICE

CERTIFICATE OF CORRECTION

PATENT NO. : 4,975,746

DATED : December 4, 1990

INVENTOR(S) : MIYAUCHI, ET AL.

It is certified that error appears in the above-identified patent and that said Letters Patent is hereby corrected as shown below:

ON TITLE PAGE:

AT [56] References Cited:

"3,256,855 4/1963 Oliphant" should read
--3,256,855 6/1966 Oliphant--

COLUMN 1

Line 21, "abovementioned" should read --above-mentioned--.
Line 58, "FIG. 5/shows" should read --FIG. 5 shows--.

COLUMN 3

Line 28, "in" should be deleted.
Line 53, "in" should be deleted.
Line 54, "in" should be deleted.
Line 57, "in" should be deleted.

COLUMN 4

Line 55, "remained" should read --remaining--.
Line 66, "in" should be deleted.

COLUMN 5

Line 1, "developing roller" should read --developing roller 4--.
Line 4, "gear 12" should read --gears 12--.
Line 15, "to which" should read --in which--.

UNITED STATES PATENT AND TRADEMARK OFFICE

CERTIFICATE OF CORRECTION

PATENT NO. : 4,975,746

DATED : December 4, 1990

INVENTOR(S) : MIYAUCHI, ET AL.

It is certified that error appears in the above-identified patent and that said Letters Patent is hereby corrected as shown below:

COLUMN 6

Line 35, "to" should read --in--.

COLUMN 8

Line 8, "in" should be deleted.

Signed and Sealed this

Fourth Day of August, 1992

*Attest:*

DOUGLAS B. COMER

*Attesting Officer*

*Acting Commissioner of Patents and Trademarks*